United States Patent [19]

Miyauchi

[11] Patent Number: 4,744,172

[45] Date of Patent: May 17, 1988

[54] APPARATUS FOR RECIPROCALLY MOVING WINDOW PANEL

[75] Inventor: Shizuya Miyauchi, Shimizu, Japan

[73] Assignee: Koito Seisakusho Co., Ltd., Tokyo, Japan

[21] Appl. No.: 930,939

[22] Filed: Nov. 17, 1986

[30] Foreign Application Priority Data

Nov. 22, 1985 [JP] Japan ..... 60-262989
Oct. 13, 1986 [JP] Japan ..... 61-242547

[51] Int. Cl.[4] ..... E05F 11/42

[52] U.S. Cl. ..... 49/349; 49/352; 49/362

[58] Field of Search ..... 49/349, 352, 360, 362

[56] References Cited

U.S. PATENT DOCUMENTS

| | | | |
|---|---|---|---|
| 1,406,142 | 2/1922 | Asbury | 49/352 |
| 3,174,742 | 3/1965 | Stelzer | 49/349 |
| 4,074,463 | 2/1978 | Colanzi | 49/349 X |
| 4,168,595 | 9/1979 | Pickles et al. | 49/352 |
| 4,222,202 | 9/1980 | Pigeon | 49/352 |
| 4,400,913 | 8/1983 | Krantz et al. | 49/352 |
| 4,403,450 | 9/1983 | Ishii | 49/352 |
| 4,502,247 | 3/1985 | Kobayashi et al. | 49/352 |
| 4,642,941 | 2/1987 | Staran et al. | 49/352 |

FOREIGN PATENT DOCUMENTS 57-140580 9/1982 Japan .

*Primary Examiner*—Philip C. Kannan
*Attorney, Agent, or Firm*—Browdy and Neimark

[57] ABSTRACT

A vehicle window panel regulating device comprising: a guide rail rigidly connected to a frame of the window and including a vertically extending linear portion and a bent portion connected to the lower end of the linear portion, a bracket connected to the window panel and slidable along the linear portion of the guide rail, at least two vertically spaced driving gears mounted along the guide rail, and an elongated member connected to the bracket and having rack teeth for engaging with at least one of the driving gears. The elongated member is slidably guided by the guide rail and is flexible at least in one direction so as to follow the bent portion of the guide rail when the bracket approaches to the lower end of the stroke.

14 Claims, 9 Drawing Sheets

APPARATUS FOR RECIPROCALLY MOVING WINDOW PANEL

FIELD OF THE INVENTION

The present invention relates to an apparatus for reciprocally moving a window panel of a vehicle such as an automobile and the like and, particularly, to a door window panel opening and closing apparatus.

DESCRIPTION OF THE PRIOR ART

Various types of vehicle door window panel opening and closing apparatus have been suggested and utilized. FIG. 13 shows one example of prior art vehicle door window panel reciprocally moving apparatus of a cable type disclosed in Japanese Utility Model Pulbic Disclosure 57-140580. The apparatus includes a guide rail a extending vertically in the interior or a door of a vehicle, and a bracket b vertically movably supported on the guide rail a and supporting the lower end of a window panel c. The bracket b is connected to one ends of first and second wires $d_1$ and $d_2$. The first wire $d_1$ extends vertically downward from the bracket b, turns around a pulley e at the lower end of the guide rail a, extends vertically upwards to an arcuate guide groove $g_1$ in a cable guide f and through a first flexible pipe $h_1$ which is connected to one end of the guide groove $g_1$. The second wire $d_2$ extends upward from the bracket b, changes the direction in an arcute guide groove $g_2$ in the cable guide f, and extends into a second flexible pipe $h_2$. The flexible pipes $h_1$ and $h_2$ are connected to a housing j of an actuator i, and a reel l rotated by a handle k is disposed in the housing j with the wires $d_1$ and $d_2$ being turned around and connected to the reel l.

In operation, when the handle k is rotated in counterclockwise direction or arrow A direction as viewed in FIG. 13, the wire $d_1$ is rolled on the reel l and the wire $d_2$ is unrolled from the reel l, whereby the bracket b moves downward and the window opens. When the handle k is rotated in clockwise direction or in the direction opposite to arrow A, the wire $d_2$ is rolled up on reel l and the wire $d_1$ is drawn out of the reel l, whereby the bracket b moves upward and the window closes. The amount of maximum vertical displacement of the bracket b or the effective stroke L of the window panel c is the distance between the upper end of the periphery of the pulley e and the lower end surface of the cable guide f minus the height of the bracket b.

In aforementioned prior art device, the effective stroke L is restricted by the presence of pulley 3 and cable guide f such that in increasing the effective stroke the pulley 3 or the cable guide f must be moved downward or upward from the positions shown in FIG. 13, however, the construction of doors in usual automobiles is limited by other factors such as design, usage or the like, and the space allotted for the window panel moving apparatus does not usually permit the change in position of the pulley or the cable guide. Further, the effective stroke can be increased by reducing the curvature of the guide grooves $g_1$ and $g_2$ of the cable guide or the pulley e, however, such countermeasure is hazardous in smooth operaton of the handle k and in durablility of wires $d_1$ and $d_2$. Accordingly, it is not possible to increase the effective stroke of the window panel and to increase the height of the window as compared with that of the door, thus, a substantial amount of window glass is remained in the interior of the door in the uppermost position of the window glass which increases the cost of the glass.

Further, there are problems that the size is bulky, a large opening is required in the door for mounting the apparatus which decreases the strength, and that the sliding resistance of wires is relatively large which decreases the force transmitting efficiency.

SUMMARY OF THE INVENTION

An object of the present invention is to overcome the shortcomings in the prior art devices and, according to the invention, there is provided an apparatus for moving reciprocally a window panel in vertical directions, and comprising: stationary guide means extending along a predetermined path including a linear portion which extends generally in vertical directions, a displaceable member for supporting the window panel which is supported on a linear portion of guide means and is displaceable in vertical directions, and means for driving the displaceable member with at least a part thereof being releasably engaging with a part of the displaceable member.

In the apparatus according to the present invention, the engagement between the displaceable member and driving means is partially released at the upper end portion and/or the lower end portion of the stroke of the displaceable member, thus, the stroke is increased.

According to a preferred embodiment, the displaceable member comprises a rigid member such as a bracket which is slidably supported and guided on the linear portion of guide means and a flexible member connected to the rigid member which engages with at least a part of the driving means. The flexible member is guided by guide means and can follow both of the linear portion and a curved portion of guide means.

BRIEF DESCRIPTION OF THE DRAWINGS

The invention will now be explained in detail with reference to attached drawings, wherein.

BRIEF DESCRIPTION OF PREFERRED EMBODIMENTS

Figure 1:
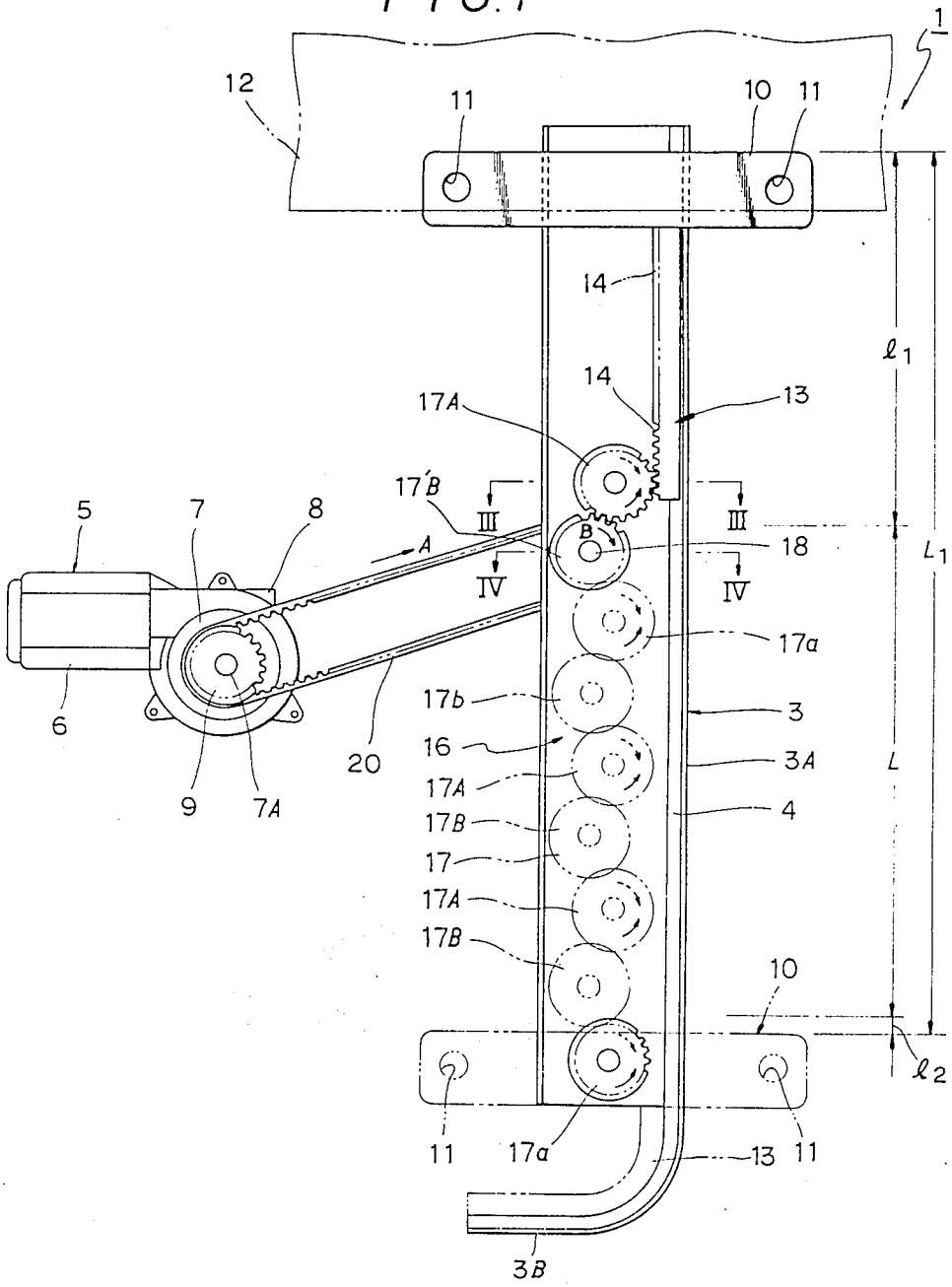
FIG. 1 is a schematic front view of an apparatus for receiprocally moving a window panel according to a first embodiment of the present invention.

A first embodiment of the present invention shown in FIGS. 1–4 is installed in a vehicle door main body 2 and comprises a guide rail 3 having a linear portion which extends generally in the vertical direction within the door main body 2, a drive mecahnism 5 including a motor 6, a series of gears 16 arranged generally vertically along the guide rail 3, a transmitting mechanism including a timing belt 20, and a bracket 10 slidably supported on the linear portion of the guide rail and supporting a window panel or a window glass 12.

Figure 3:
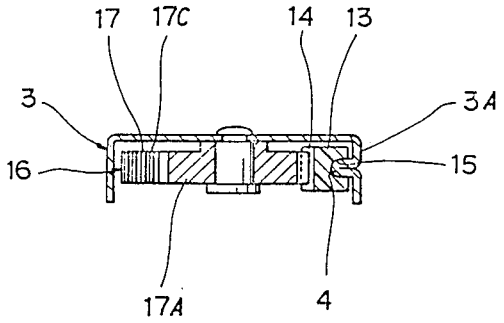
FIG. 3 is a section taken along line III—III in FIG. 1.
Figure 4:
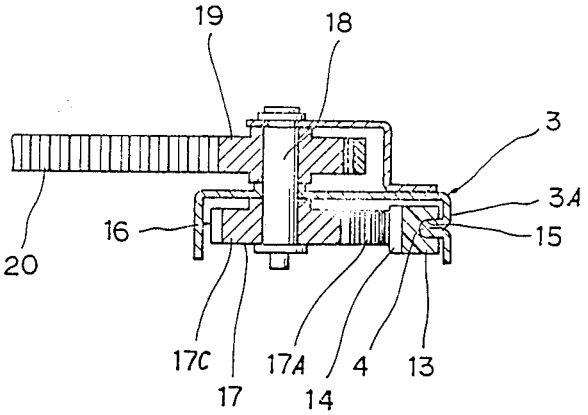
FIG. 4 is a section taken along line IV—IV in FIG. 1.

The guide rail 3 is preferably formed of a sheet metal and has generally U-shaped cross-section as shown in FIGS. 3 and 4. There is provided a projection on the inner surface of one of the side walls 3*a* to constitute a slide portion 4 which extends in the longitudinal direction of the guide rail 3 for guiding a slide rack 13 which will be explained in detail hereinafter. In the embodiment, the slide portion 4 is formed by deforming the metal sheet, but, the slide portion may be formed as a separate member and secured to the guide rail by any desired process such as welding or the like. The lower end portion of the guide rail 3 is bent gently to form a bent portion 3*b*.

The drive mechanism 5 comprises the motor 6 which is preferably a DC motor, a speed reduction mechanism 7, a rotating direction switching mechanism 8, the timing pulley 9 secured to an output shaft 7*a* of the reduction mechanism 7, and gears 16.

The bracket 10 is preferably formed of synthetic resin material, and has a generally rectangular plate like main body portion and the slide rack 13 integrally connected to the main body portion to extend downwards therefrom. There is provided suitable retaining means (not shown) between the guide rail 3 and the bracket 10 to permit sliding movements of the bracket 10 along the linear portion of the guide rail 3. Shown at 11 and 11 are mounting holes for mounting the window panel 12 to the bracket 10 by such as screws and the like.

The slide rack 13 is rigidly connected or integrally formed with the bracket 10 to extend downwards therefrom by a substantial length, and has an engaging groove 15 in one side surface for slidably engaging with the slide portion 4 of the guide rail 3 and a series of rack teeth 14, 14 . . . on the side surface opposite to the engaging groove 15. The rack teeth engage with gears of the drive mechanism 5. The slide rack 13 is formed of a flexible material or has the construction flexible at least in one direction such that the slide rack 13 can slidingly follow the bent portion 3*b* of the guide rail 3 when the slide rack moves to the lower end of the stroke, but the slide rack is sufficiently tough in the direction of the length to support the window panel 12.

A plurality of intermeshing zigzag gears 17, 17 . . . are mounted on the guide rail 3 along the vertical direction with gears 17*a*, 17*a* . . . on the side of slide rack 13 being adapted to engage with the rack teeth of the slide rack 13, and gears 17*b*, 17*b* . . . on the side remote from slide rack 13 rotate in the direction opposite to gears 17*a* . . . A driven timing gear 19 is secured to a shaft 18 of a suitable gear 17′*b* of gears 17*b*, and is driven through a timing belt 20 by the timing pulley 9 of the drive mechanism 5.

In operation, when the DC motor 6 of drive mechanism 5 rotates in the normal direction, the timing belt 20 is rotated in arrow A direction in FIG. 1 and the gear 17′*b* rotates in arrow B direction in FIG. 1. The gear 17′*b* acts to rotate gears 17*a* in the direction opposite to arrow B direction and gears 17*b* in arrow B direction. The rotation of one or more gears 17*a* meshing with rack teeth 14 of the slide rack 13 acts to displace the slide rack 13 upwards whereby the window panel 12 secured to the bracket 10 moves upward. At the end of the stroke, a window 2*a* of the door 2 (FIG. 2) is fully closed and the DC motor stops. At this condition, at least one gear 17*a* engages with rack teeth 14 of the slide rack 13 thereby retaining the window 2*a* in the closed condition.

When the DC motor 6 rotates in the reverse direction, the timing pulley 9 rotates in the direction opposite to arrow A direction, the gear 17′*b* is rotated through the timing belt 20 in the direction opposite to arrow B, and gears 17*a* are rotated in the direction opposite to gears 17*b*. Thus, the slide rack 13 together with the bracket 10 moves downward to open the window 2*a*. In the course of downward movement, the slide rack 13 engages with one or the uppermost gear 17*a* initially, then, upper two gears 17*a*, then upper three gears, thereafter disengages from the gears arranged in the upper portion in response to engaging with the gears in the lower portion. At the end of the stroke as shown in chain lines in FIG. 1, the slide rack 13 engages only with the lowermost gear 17*a*, and a substantial length of the slide rack 13 which extends vertically downward from the bracket 10 normally is bent along the bent portion 3*b* of the guide rail 3 to follow the curvature. Thus, the effective stroke of the bracket 10 is increased relative to the dimension of the door. Namely, the effective stroke $L_1$ of the bracket 10 is a length L of the gear train 16 as defined by the distance between the uppermost and the lowermost gears 17*a* plus upper and lower extended displacement $l_1$ and $l_2$ corresponding to the length of the slide rack as shown in FIG. 1, or $L_1=L+l_1+l_2$.

Figure 2:
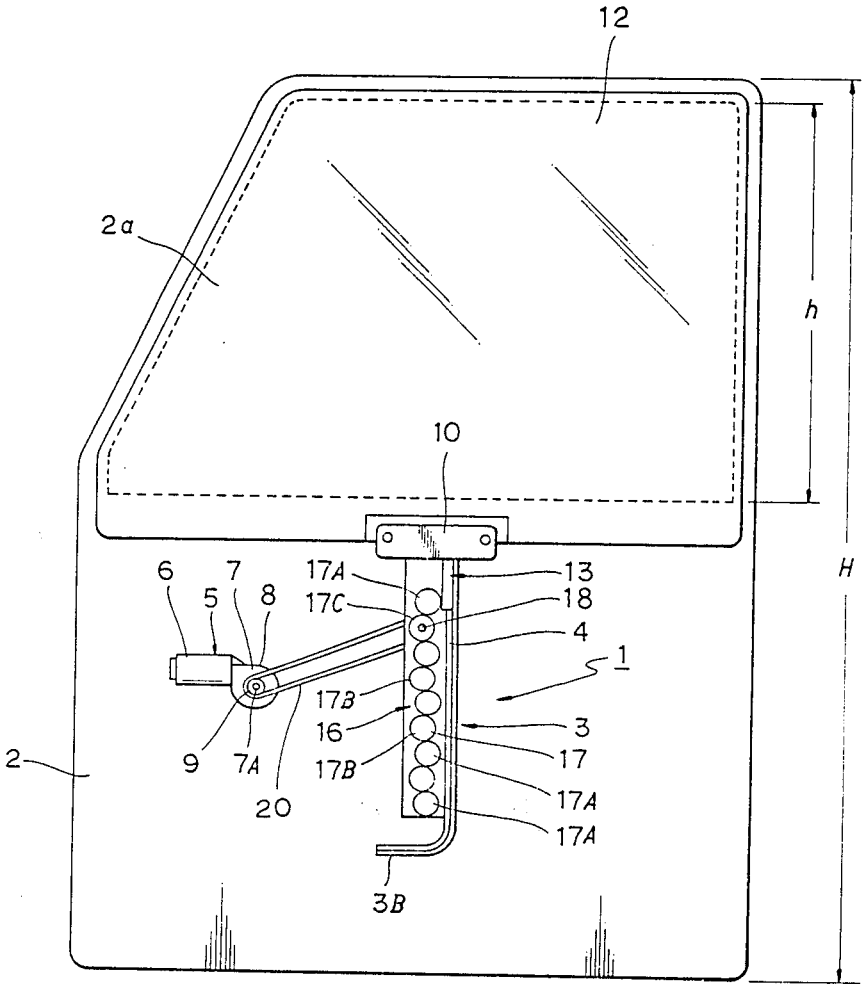
FIG. 2 is a schematic view showing the apparatus of FIG. 1 as installed in a door of a vehicle.

Accordingly, as shown in FIG. 2, the height h of the window 2*a* relative to the height H of the door 2 can be increased by the distance $l_1+l_2$ as compared with prior art device with the window glass 12 being of the same height, or when the height h of the window 2*a* is equal then the overall height of the window glass 12 can be decreased by the distance $l_1+l_2$ whereby the cost of the window glass can be decreased. Further, the plurality of gears 16 constitute the drive mechanism, thus, it is possible to prevent the failure and to improve the durability. Further, the motor 5 can be located at any desired location.

Figure 5:
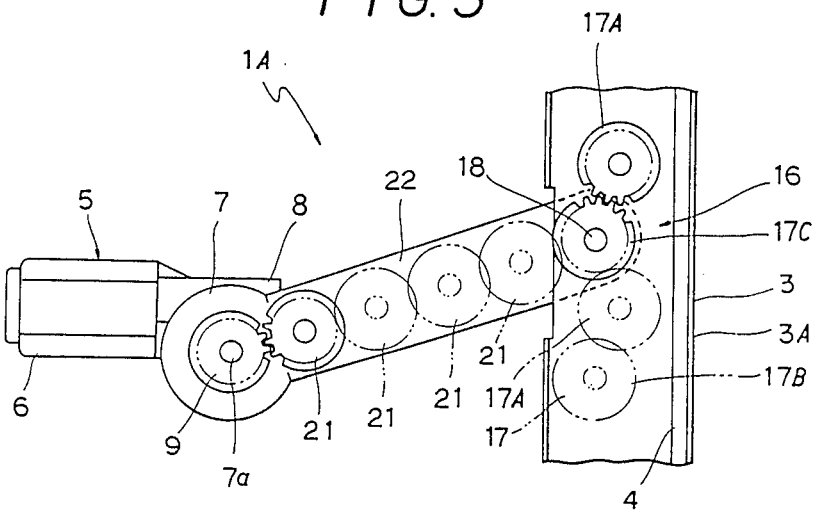
FIG. 5 is a schematic front view showing a second embodiment of the invention.

FIG. 5 shows the second embodiment of the invention, wherein the power transmitting mechanism between the DC motor 6 and the gear 17*b* is modified.

A plurality of intermeshing gears 21 are provided, as shown in FIG. 5, between the timing gear 9 and one 17′*b* of gears 17*b* of the gear train 16. The gears 21 are received in or mounted on a housing or mounting bracket 22 which is angularly displaceable around the axis 18 of the gear 17′*b*. The arrangement is advantageous since the freedom in design and the service life is improved.

Figure 6:
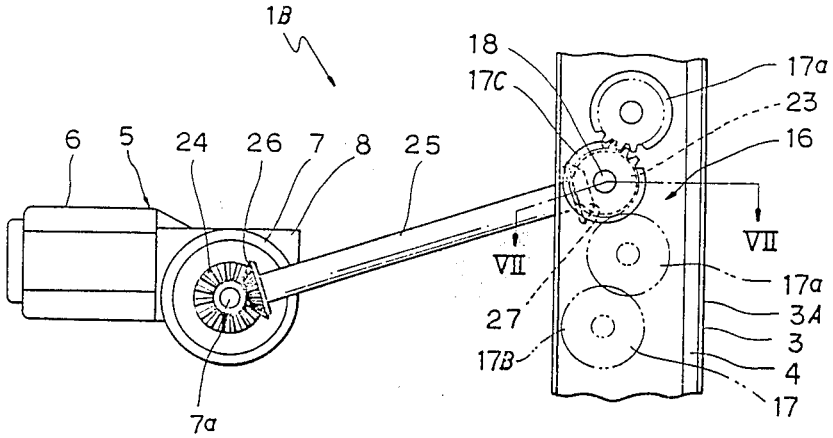
FIG. 6 is a schematic front view showing a third embodiment of the invention.
Figure 7:
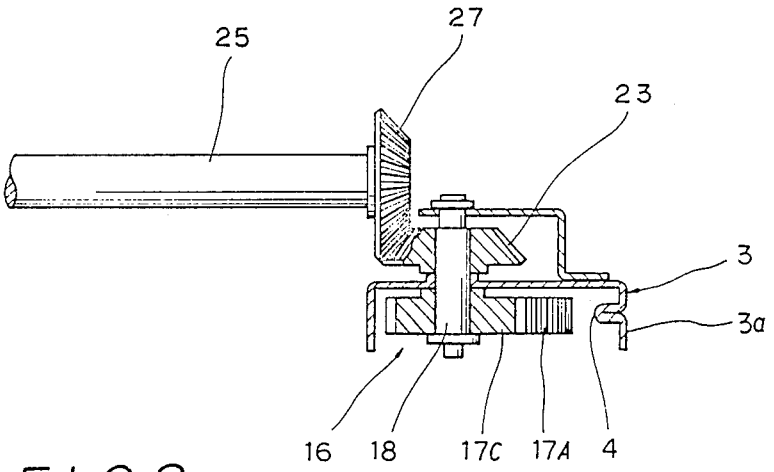
FIG. 7 is a section taken along line VII—VII in FIG. 6.

FIGS. 6 and 7 show the third embodiment of the present invention, wherein the gears 21 in FIG. 5 is substituted by a bevel gear 23 secured to the shaft 18 of the gear 17′*b*, a bevel gear 24 secured to the output shaft 7*a* of the reduction mechanism 7, and a rotatable shaft 25 having on opposite ends a bevel gear 26 meshing with the gear 24 and a bevel gear 27 meshing with the gear 23. The third embodiment has the effect similar to that of the second embodiment, and the construction is simple.

Figure 8:
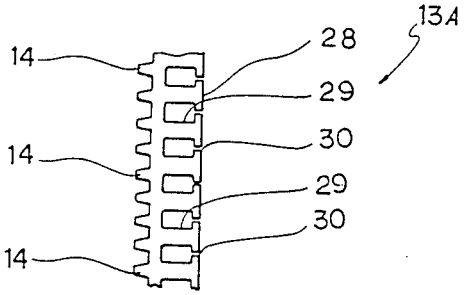
FIG. 8 is a partial front view showing a modified slide rack.
Figure 9:
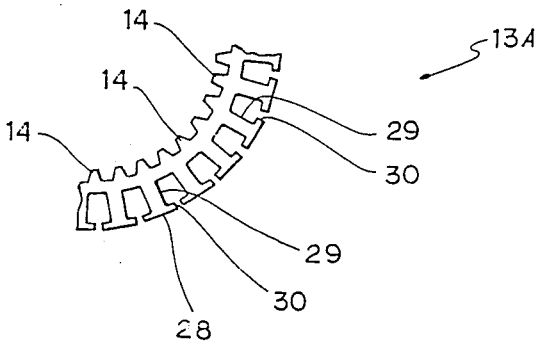
FIG. 9 is a partial front view of the slide rack of FIG. 8, but showing a bent condition.

FIGS. 8 and 9 show a modified slide rack 13A, which includes a plurality of holes 29 which are spaced in the lengthwise direction by a predetermined pitch, and are disposed adjacent to the side 28 remote from rack teeth 14, and slits 30 formed between respective holes 29 and the side 28. The slide rack can smoothly bend as shown in FIG. 9, and can transmit sufficiently the vertical force (compressive force) in the condition of FIG. 8.

Figure 10:
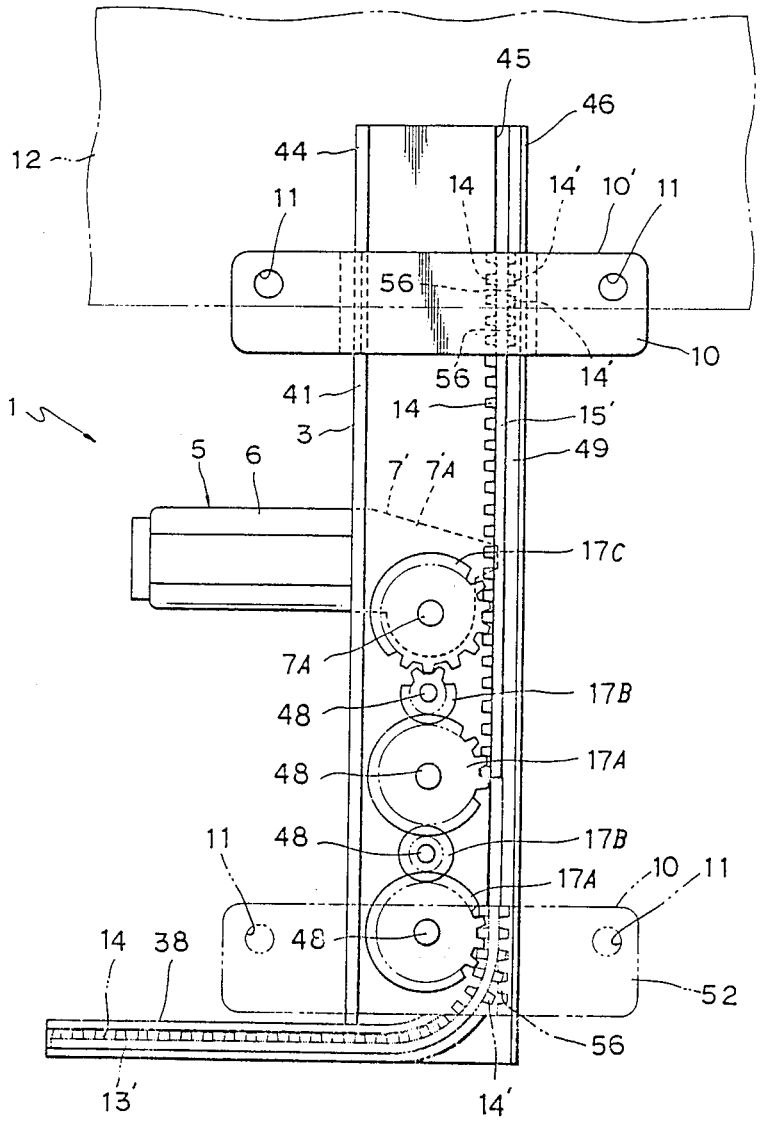
FIG. 10 is a schematic view of a fourth embodiment of the present invention.
Figure 11:
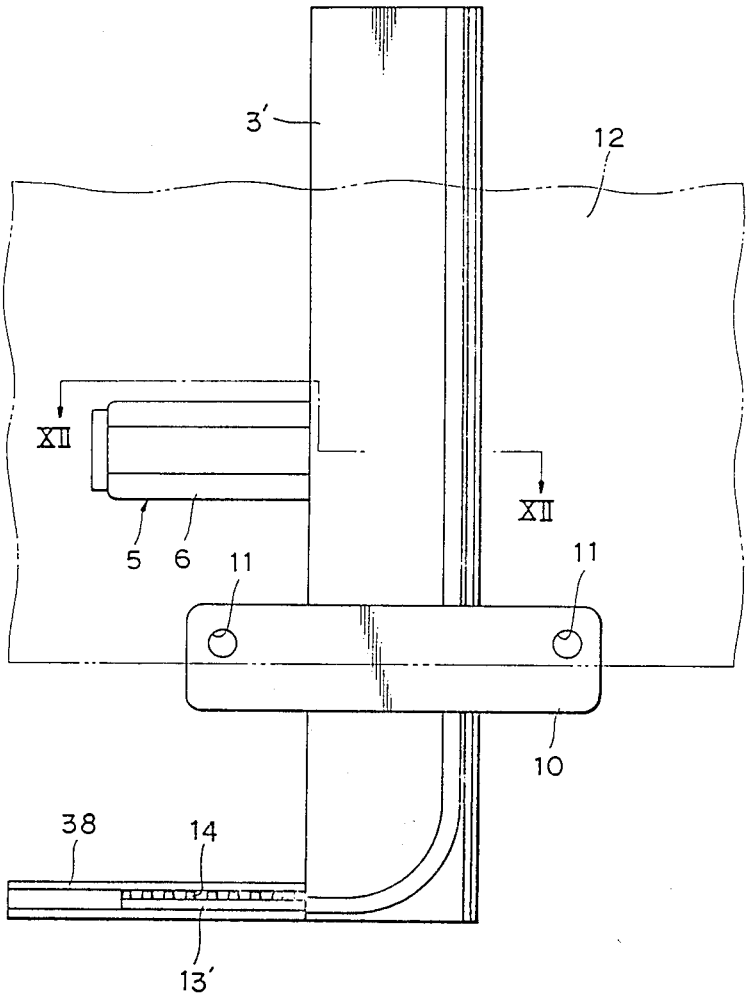
FIG. 11 is a front view of the apparatus of FIG. 10.
Figure 12:
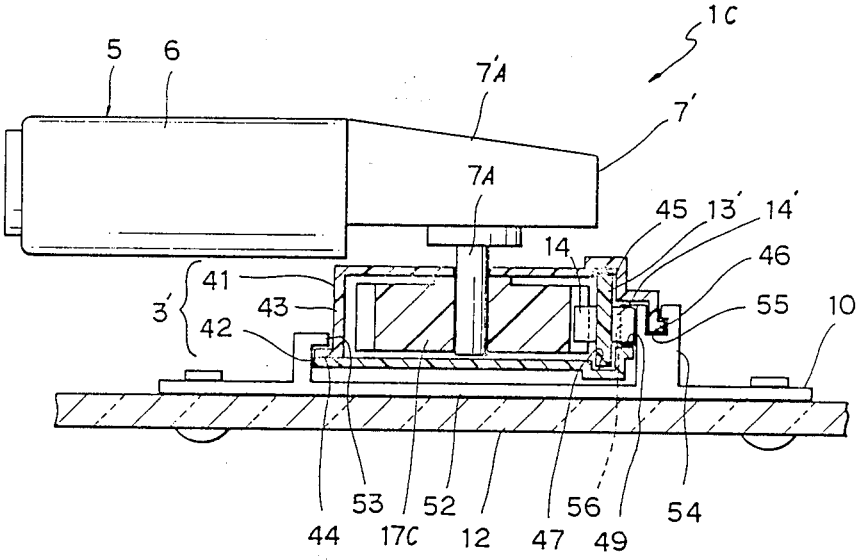
FIG. 12 is a section taken along line XII—XII in FIG. 11.
Figure 13:
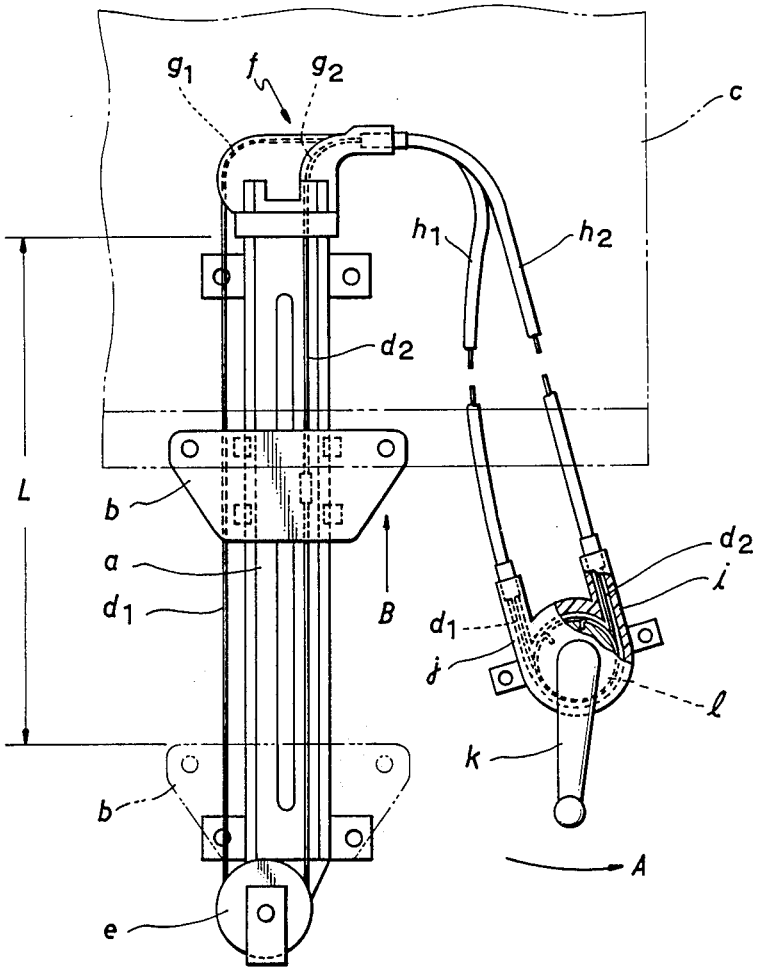
FIG. 13 (PRIOR ART)
FIG. 13 is a front view of a prior art device.

FIGS. 10, 11 and 12 show the fourth embodiment of the invention, which is generally similar to the embodiment of FIG. 1, but the details of components substantially differ. The guide rail 3' consists of a main portion 41 and a cover 42. The main portion 41 is formed by bending a sheet metal to have a side wall 43 on one of the side edges. An engaging edge 44 is formed on the tip end of the side wall 43 to project outwards. A sliding groove 45 is formed along another side edge of the main portion 41, and a crooked engaging portion 46 extends from the sliding groove 45.

The cover 42 is also formed on a metal sheet, and one of side edges thereof is adapted to overlap the engaging edge 44 of the main portion 41. A sliding groove 47 is formed along another side edge to oppose the engaging groove 45 in the main portion 41. A longitudinal opening 49 is formed between the engaging portion 46 of the main portion 41 and the another side edge of the cover 42.

As shown in FIG. 10, a plurality of vertically spaced supporting shafts are mounted on the guide rail 3' and extend respectively between the main portion 41 and the cover 42. The sliding grooves 47 and 45 in the cover and the main portion of the guide rail are formed to have smoothly bent configuration at the lower end portion as clearly shown in FIG. 11, and a conduit 38 is mounted on the guide rail to extend transversely therefrom and to support a slide member 13' in the lower end portion of the downward stroke of the bracket which will be explained in detail hereinafter.

A casing 7'A of a speed reduction mechanism 7' of the drive mechanism 5 is secured to rear surface of the main portion 41 of the guide rail 3' at the lengthwise center portion. An output shaft 7A of the speed reduction means 7' extends into the interior of the guide rail 3' and is secured to a drive gear 17C which, in turn, drives driving gears 17A and 17A through idle gears 17B and 17B thereby constituting a series of intermeshing gears such as shown in FIG. 1. It will be understood that the gear train of FIG. 10 includes idle gears of small diameter, and the gear train of FIG. 1 includes idle gears of the same diameter, but the function thereof is similar. Thus the drive gears rotate in the same direction and idle gears rotate in the opposite direction.

There is provided a slide member 13' between the bracket 10 and the guide rail to extend generally in the vertical direction. The slide member is formed of a flexible material and has generally band like shape with rack teeth 14 and 14' being provided on opposite side surfaces thereof, and is slidably guided by the guide grooves 45 and 47 of the guide rail 3'. The rack teeth 14 are adapted to engage with the driving gears 17A, and the rack teeth 14' act to connect the slide member 13' with the bracket 10. It will be noted that the rack teeth 14' are provided only the upper end portion of the slide member 13'.

The bracket 10 comprises a plate like main body 52, a first retaining member 53 projecting on the rear surface of the main body at one side, and a second retaining member 54 projecting on the rear surface of the main body at the other side. The retaining member 53 slidably engages with the engaging edge 44 of the guide rail 3', and the retaining member 54 slidably engages with the engaging portion 46 of the guide rail 3' whereby the relative movement between the bracket and the guide rail is restricted to vertical sliding movement. Shown at 55 is a sliding recess formed in the projecting end portion of the retaining member 54 and having the configuration corresponding to the engaging portion 46. The retaining member 54 further has rack teeth 56 which project into the interior of the guide rail through the opening 49 to engage with rack teeth 14' of the slide member 13'.

The operation and function of the fourth embodiment of the invention are similar to the first embodiment, thus, detailed description therefore is omitted. But, it will be noted that, as shown in chain lines in FIG. 10, the engagement between the rack teeth 56 of the bracket 10 and the rack teeth 14' of the slide member 3' is partially released at the end of the downward movement of the bracket, which permits the bent portion of guide rail closely adjacent to the lowermost positon of the bracket thereby decreasing the overall height of the apparatus. Further, in applying the invention to the vehicle window panel reciprocally moving apparatus, it is possible to increase the height of the window as compared with that of the door, to improve the operational characteristics of the apparatus and to improve the durability.

As described heretofore, according to the invention, the effective stroke can substantially be increased over the height of the driving gear train which is arranged along the length of the guide rail.

Although the embodiments of the invention have been chosen for purposes of illustration, it will be noted that the invention is not restricted by the embodiments, and those skilled in the art can easily make various changes and revisions within the scope of the following claims.

What is claimed is:

1. An apparatus for reciprocally moving a window panel in vertical direction, comprising:

stationary guide means extending along a predetermined path including a linear portion which extends generally in vertical directions, a displaceable member for supporting said window panel, said displaceable member being supported on said linear portion of said guide means and displaceable in the vertical directions relative to said linear portion, and driving means for driving said displaceable member with at least a part thereof being arranged on said guide means along the same direction as the moving direction of said displaceable member, and with at least a part thereof releasably engaging with a part of said displaceable member, said driving means including a series of mutually meshing gear trains rotatably mounted on said guide means and a reciprocally rotating driving source connected to said gear trains, said gear trains including a plurality of gears rotating in the same direction and remaining gears rotating in the opposite direction, with at least a part of said gears rotating in the same direction engaging with at least a part of said displaceable member.

2. An apparatus according to claim 1, wherein said guide means include a curved portion connected to lower end of said linear portion.

3. An apparatus according to claim 2, wherein at least a part of said displaceable member is flexible to follow the curved portion of said guide means.

4. An apparatus according to claim 1, wherein said displaceable member comprises a rigid member slidingly guided on said linear portion of said guide means and a flexible member rigidly connected to said rigid member and engaging with at least a part of said driving means.

5. An apparatus according to claim 4, wherein said window panel is rigidly connected to said rigid member.

6. An apparatus according to claim 1, wherein the diameter of each of said gears rotating in the same direction is larger than that of said remaining gears.

7. An apparatus according to claim 1, wherein said displaceable member comprises a band-like elongated flexible member with opposite side edges thereof slidingly guided by correspondingly shaped guide grooves in said guide means, and having on one surface thereof rack teeth for engaging with at least one of said gears rotating in the same direction.

8. An apparatus according to claim 1, wherein said displaceable member comprises an elongated flexible member having on one side surface thereof a plurality of rack teeth along the longitudinal direction and, on the other side surface thereof, means for slidingly engaging with said guide means.

9. An apparatus according to claim 8, wherein said means for slidingly engaging with guide means include a longitudinally extending groove in said flexible memeber for slidingly engaging with a correspondingly shaped ridge on said guide means.

10. An apparatus for reciprocally moving a window panel in vertical directions, which comprises:

stationary guide means extending along a predetermined path including a linear portion which extends generally in vertical directions, a displaceable member for supporting said window panel, said displaceable member being supported on said linear portion of said guide means and displaceable in the vertical directions relative to said linear portion, and driving means for driving said displaceable member with at least a part thereof being arranged on said guide means along the same direction as the moving direction of said displaceable member, and with at least a part thereof releasably engaging with a part of said displaceable member, said driving means including a series of mutually meshing gear trains rotatably mounted on said guide means and a reciprocally rotating driving source connected to said gear trains, said gear trains including a plurality of gears rotating in the same direction and remaining gears rotating in the opposite direction, with at least a part of said gears rotating in the same directions engaging with at least a part of said displaceable member, and wherein said gears rotating in the same direction are aligned vertically and said remaining gears are displaced transversely from the first mentioned gears.

11. An apparatus according to claim 10, wherein the diameter of each of said gears is equal to each other.

12. A vehicle window regulating device for moving a window panel up and down with respect to a window frame, the device comprising:

a guide rail rigidly connected to the window frame and including a linear portion extending generally in vertical direction and a curved portion connected to the lower end of the liner portion, a bracket slidingly guided on the linear portion of the guide rail, driving means including a series of mutually meshing gear trains rotatably mounted on said guide means and a reciprocally rotating driving source connected to said gear trains, said gear trains including a plurality of gears rotating in the same direction and remaining gears rotating in the opposite direction, with at least a part of said gears rotating in the same direction, and an elongated flexible member connected to said bracket, said flexible member being slidingly guided on the guide rail, and having rack teeth engaging with at least one of said gears rotating in the same direction.

13. A vehicle window regulating device according to claim 12, wherein said flexible member is secured to the bracket and extends downwards therefrom by a substantial length, thereby increasing the stroke of the window.

14. A vehicle window regulating device according to claim 12, wherein said flexible member is detachably connected to the bracket.

* * * * *